US007963779B1

(12) United States Patent
Zhang et al.

(10) Patent No.: US 7,963,779 B1
(45) Date of Patent: Jun. 21, 2011

(54) ELECTRICAL PLUG HAVING ADJUSTABLE PRONGS

(75) Inventors: Shuai Zhang, Shenzhen (CN); Yan-Yan Cao, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/846,850

(22) Filed: Jul. 30, 2010

(30) Foreign Application Priority Data

Dec. 8, 2009 (CN) ..... 2009 1 0311083

(51) Int. Cl.
*H01R 4/66* (2006.01)

(52) U.S. Cl. ..... 439/104

(58) Field of Classification Search ..... 439/104, 439/106, 640, 22, 172–173
See application file for complete search history.

(56) References Cited

U.S. PATENT DOCUMENTS

| | | | | |
|---|---|---|---|---|
| 5,220,152 | A * | 6/1993 | Doran | 219/201 |
| 6,428,339 | B1 * | 8/2002 | Davidson et al. | 439/346 |
| 7,144,266 | B2 * | 12/2006 | Bhutani | 439/352 |
| 7,462,074 | B1 * | 12/2008 | Devlin et al. | 439/640 |
| 7,510,409 | B2 * | 3/2009 | Yu | 439/131 |
| 7,513,782 | B1 * | 4/2009 | Sheldon et al. | 439/106 |

* cited by examiner

*Primary Examiner* — Jean F Duverne
(74) *Attorney, Agent, or Firm* — Zhigang Ma

(57) ABSTRACT

An electrical plug is provided. The plug includes a base, a cover, a live prong, a neutral prong, and a ground prong. The cover defines a first hole, a second hole, and a third hole through which the ground prong, the live prong, and the neutral prong, respectively extend. The ground prong includes a middle contact, a first contact including a first pin rotatably connected to the middle contact and a first blade fixed to the first pin, and a second contact including a second pin rotatably connected to the middle contact and a second blade fixed to the second pin. The first pin and the second pin are rotatably at opposite sides of the middle contact. The first blade and the second blade are on front and rear of the middle contact.

8 Claims, 7 Drawing Sheets

ELECTRICAL PLUG HAVING ADJUSTABLE PRONGS

BACKGROUND

1. Technical Field

The present disclosure relates to plugs and, particularly, to an electrical plug having adjustable prongs.

2. Description of Related Art

Electrical plugs are commonly used as connectors. Sometimes, it is a little difficult to insert an electrical plug into an electrical receptacle made by a different manufacturer because of inconsistencies in manufacturing. Therefore, there is room for improvement in the art.

BRIEF DESCRIPTION OF THE DRAWINGS

The components of the drawings are not necessarily drawn to scale, the emphasis instead being placed upon clearly illustrating the principles of an electrical plug having adjustable prong. Moreover, in the drawings, like reference numerals designate corresponding parts throughout several views.

DETAILED DESCRIPTION

Figure 1:
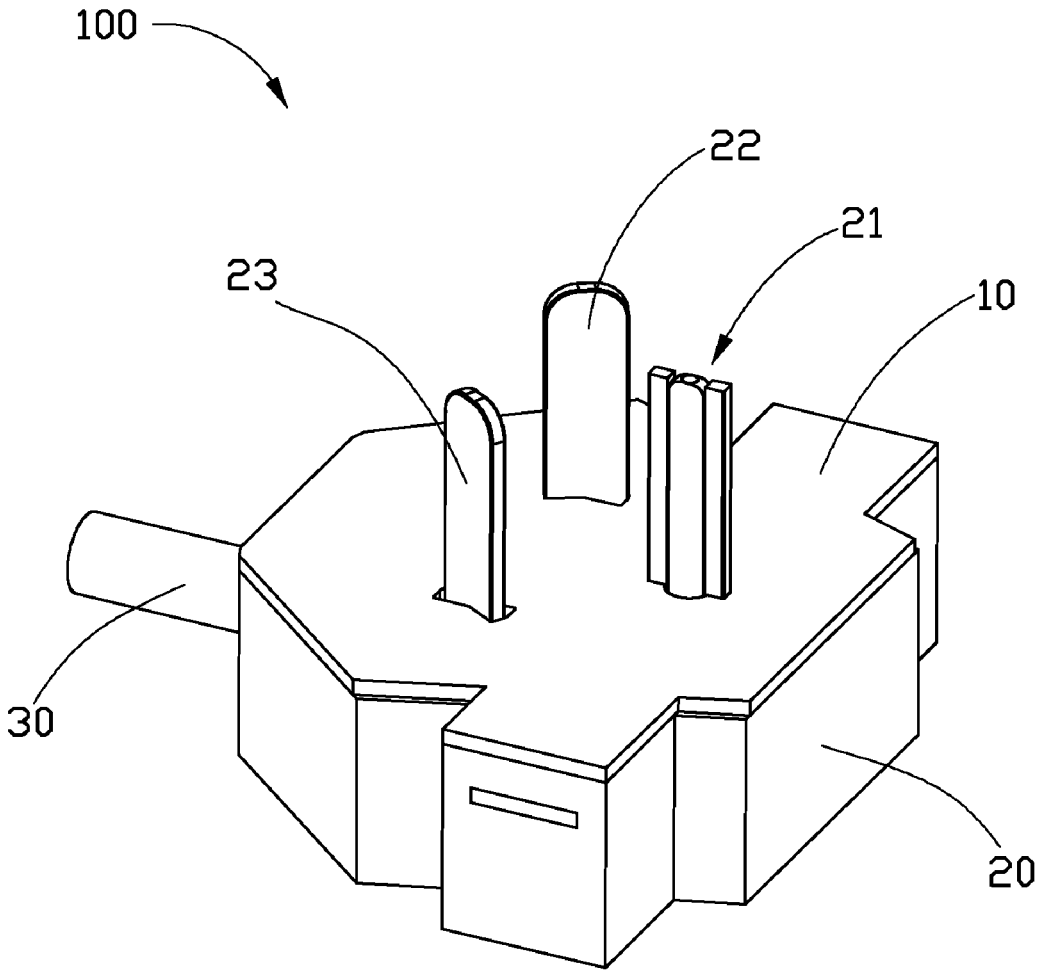
FIG. 1 is a schematic view of an electrical plug in accordance with an exemplary embodiment
Figure 2:
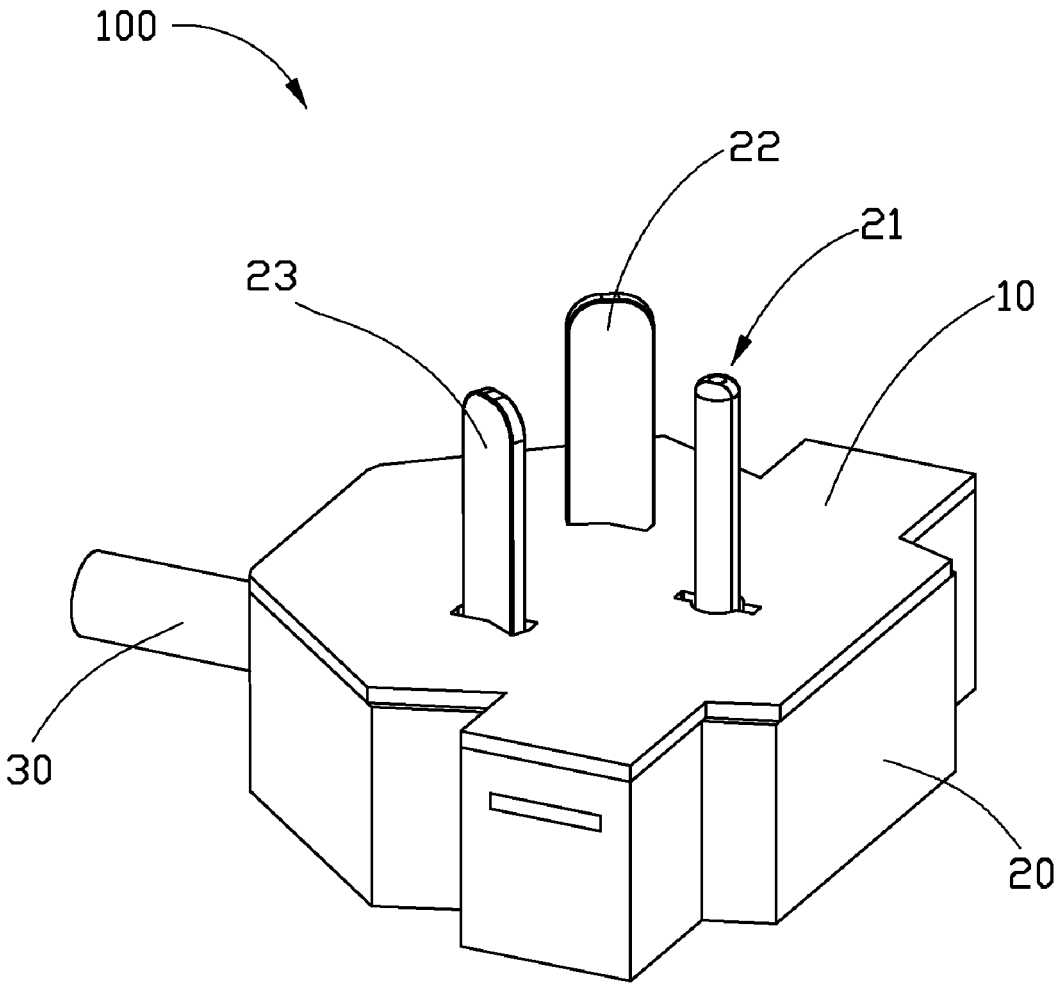
FIG. 2 is similar to FIG. 1, but showing one prong with an adjusted shape.

Referring to FIGS. 1-2, an electrical plug 100 includes a cover 10, a base 20, a ground prong 21, a live prong 22, a neutral prong 23, and a cable guide 30. The ground prong 21, the live prong 22, and the neutral prong 23 can be arranged in Y-shape or U-shape. In the embodiment, the cover 10 and the base 20 are both made of electrically insulating material. The live prong 22 and the neutral prong 23 are substantially flat. The cover 10 engages with the base 20 to define a receiving space to partly receive the ground prong 21, the live prong 22, and the neutral prong 23. A cable includes a number of wires respectively connected to the ground prong 21, the live prong 22, and the neutral prong 23, extending out through the cable guide 30.

Figure 3:
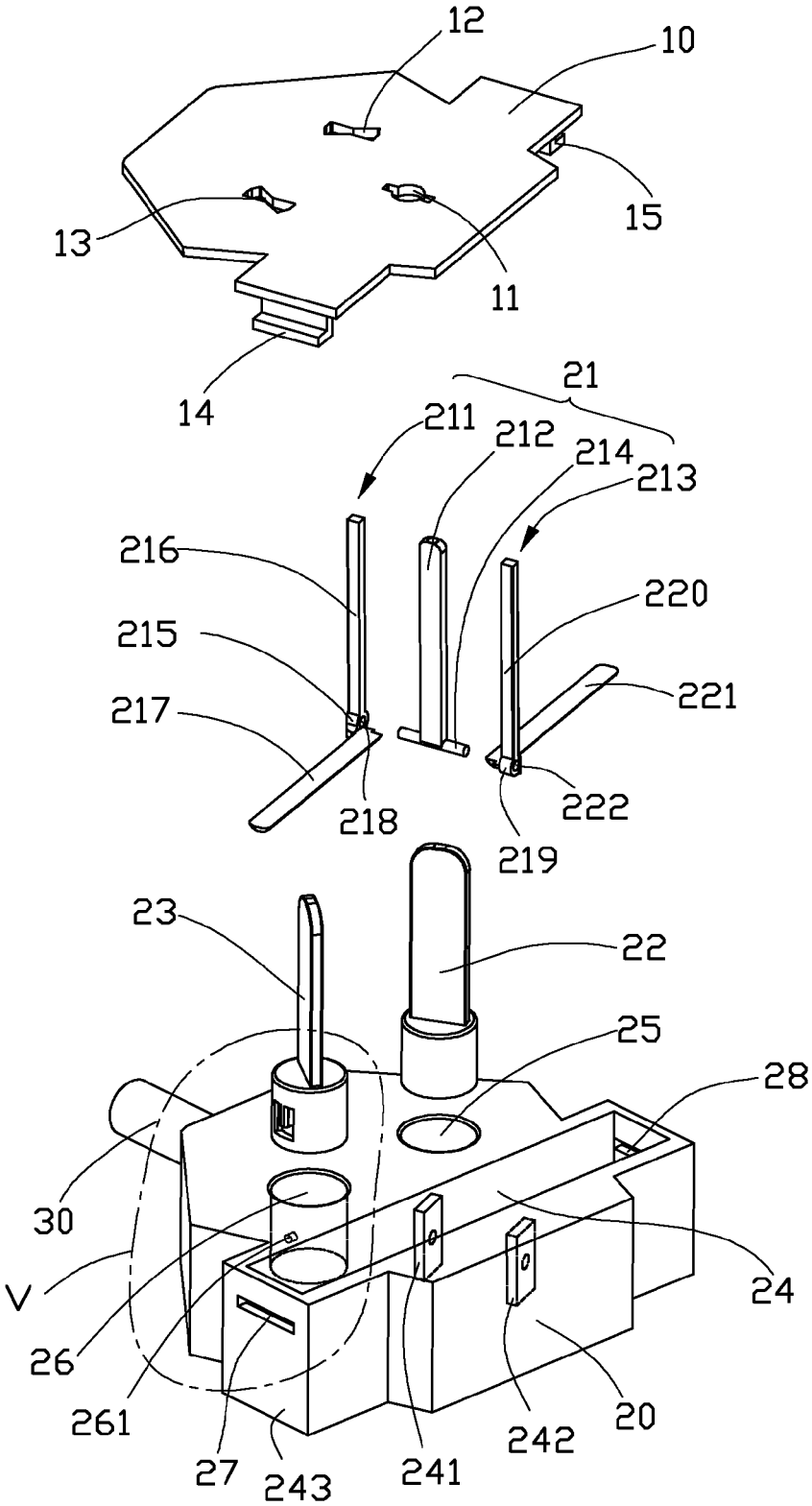
FIG. 3 is an exploded view of the plug of FIG. 1.

Referring to FIG. 3, the cover 10 defines a first hole 11, a second hole 12, and a third hole 13, through which the ground prong 21, the live prong 22, and the neutral prong 23 respectively extend. Part of the ground prong 21, the live prong 22, and the neutral prong 23 are external to the cover 10 for interfacing corresponding contacts of a compatible receptacle. Each of the second hole and third hole includes two sectorial holes (not labeled) with the narrow portions thereof connected together, allowing the live prong 22 or the neutral prong 23 to rotate to a certain degree. The first hole 11 includes a round hole (not labeled) with two slots (not labeled) extended radically from an opposite side of the round hole. The cover 10 further includes a first hook 14 and a second hook 15 at the two opposite sides.

The base 20 defines a first receiving space 24, a second receiving space 25, and a third receiving space 26 corresponding to the first hole 11, the second hole 12, and the third hole 13. In the embodiment, the shape of the first receiving space 24 is substantially rectangular. The shapes of the second receiving space 25 and the third receiving space 26 are substantially cylindrical. The first receiving space 24 defines a first opening 241 and a second opening 242 in the two opposite inner surfaces. The first receiving space 24 also includes two sidewalls 243 that respectively define a first slot 27 and a second slot 28. The first slot 27 and the second slot 28 are used for engaging the first hook 14 and the second hook 15, in such a way that the cover 10 can be snap-connected to the base 20. Each of the second receiving space 25 and the third receiving space 26 includes a lateral surface defining a protrusion 261 (only one shown).

Figure 4:
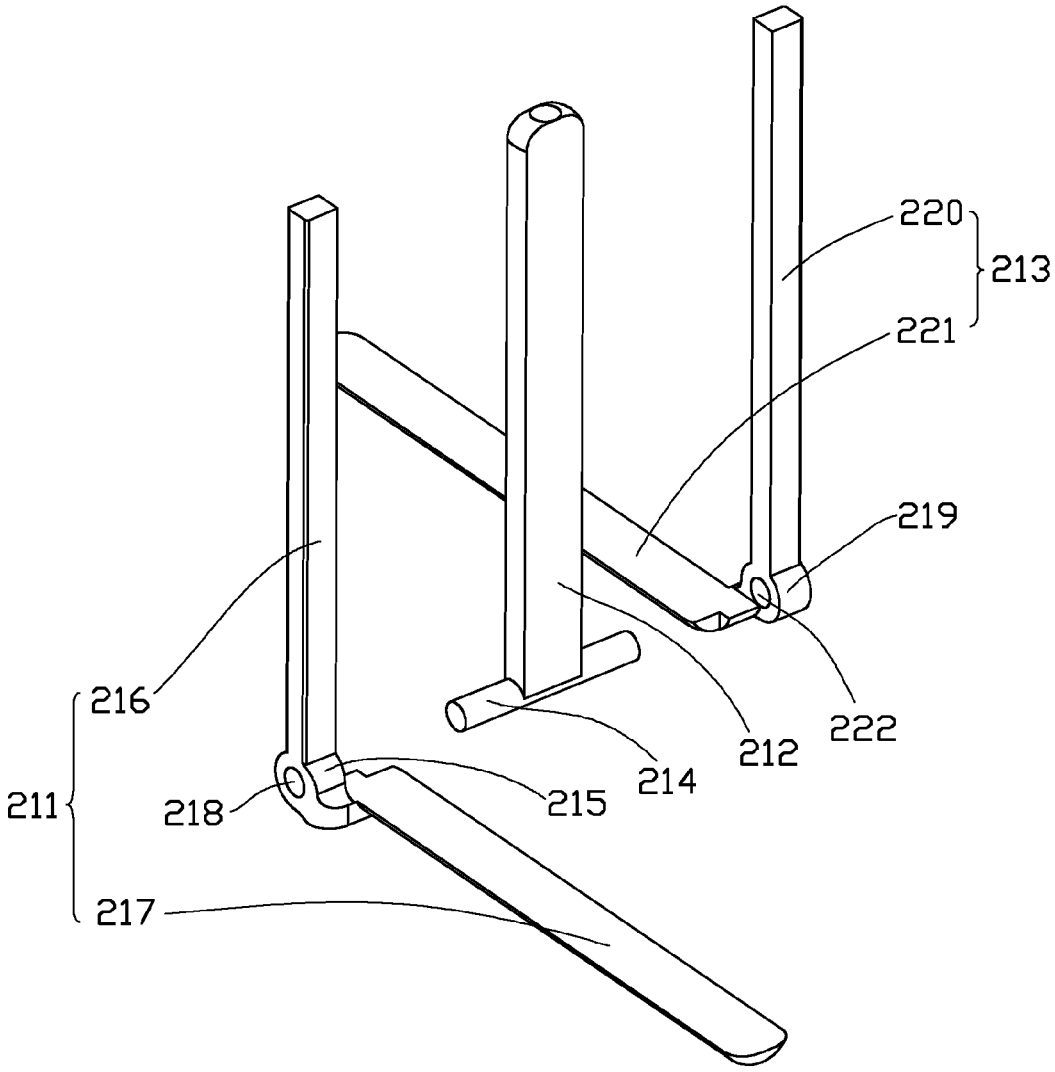
FIG. 4 is an exploded view of a ground prong of the plug of FIG. 1.

Referring to FIG. 4, the ground prong 21 includes a first contact 211, a middle contact 212, a second contact 213, and an axle 214. The middle contact 212 is substantially perpendicularly fixed to the axle 214. The first contact 211 includes a first positioning member 215, a first pin 216, and a first blade 217. The first positioning member 215 is fixed to one end of the first pin 216 and defines a first through hole 218. The first blade 217 is fixed to a side surface of the first positioning member 215 and is substantially perpendicular to the first pin 216. The first contact 211 and the second contact 213 have substantially the same structure. The second contact 213 includes a second positioning member 219, a second pin 220, and a second blade 221. The second positioning member 219 defines a second through hole 222.

One end of the axle 214 extends through the first through hole 218 and is fixed in the first opening 241 of the first receiving space 24. The other end of the axle 214 extends through the second through hole 222 and is fixed in the second opening 242 of the first receiving space 24. Both the first contact 211 and the second contact 213 can rotate around the axle 214.

Figure 5:
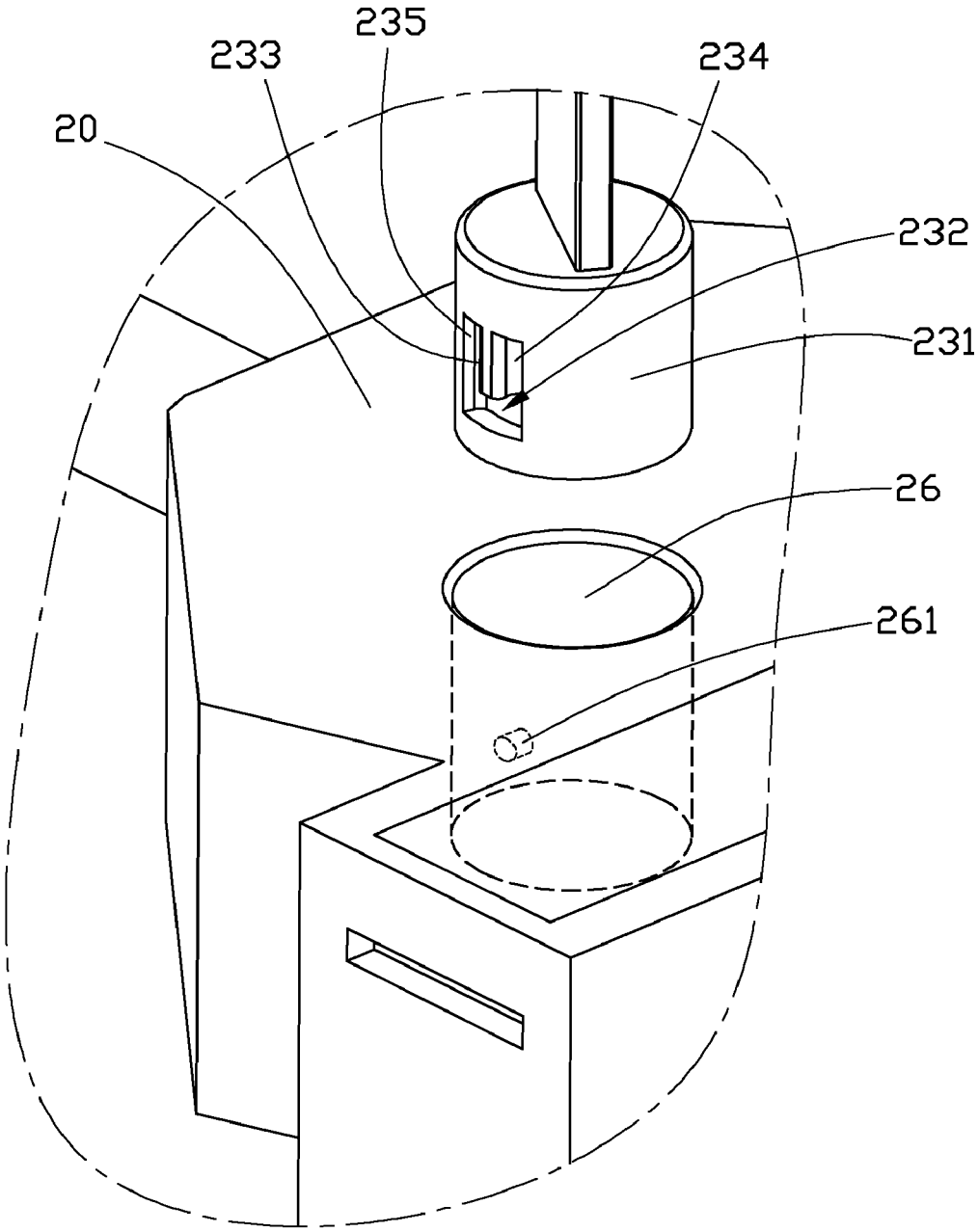
FIG. 5 is an enlarged view of the circled portion V of FIG. 3.

Referring to FIG. 5, both the live prong 22 and the neutral prong 23 include a bottom end 231. In one embodiment, the bottom end 231 is cylindrical. Each bottom end 231 defines an opening 232. A tab 233 protrudes from a top rim of the opening 232, thus forming a first slot 234 and a second slot 235. After the bottom end 231 is received in the receiving space 25 and 26, the protrusion 261 can be received in the first slot 234 or the second slot 235.

The live prong 22 and the neutral prong 23 can be adjusted a little to adapt to a receptacle, when needed. When the live prong 22 or the neutral prong 23 is pulled upward until the protrusion 261 resists the lower rim of the opening 232, the live prong 22 or the neutral prong 23 is freed from the limitation of the protrusion 261 and can rotate a little from a first orientation to a second orientation. After the live prong 22 or the neutral prong 23 is released, the live prong 22 or the neutral prong 23 moves downward and can keep its second orientation by the protrusion 261 engaging with the slot 234 or 235.

Figure 6:
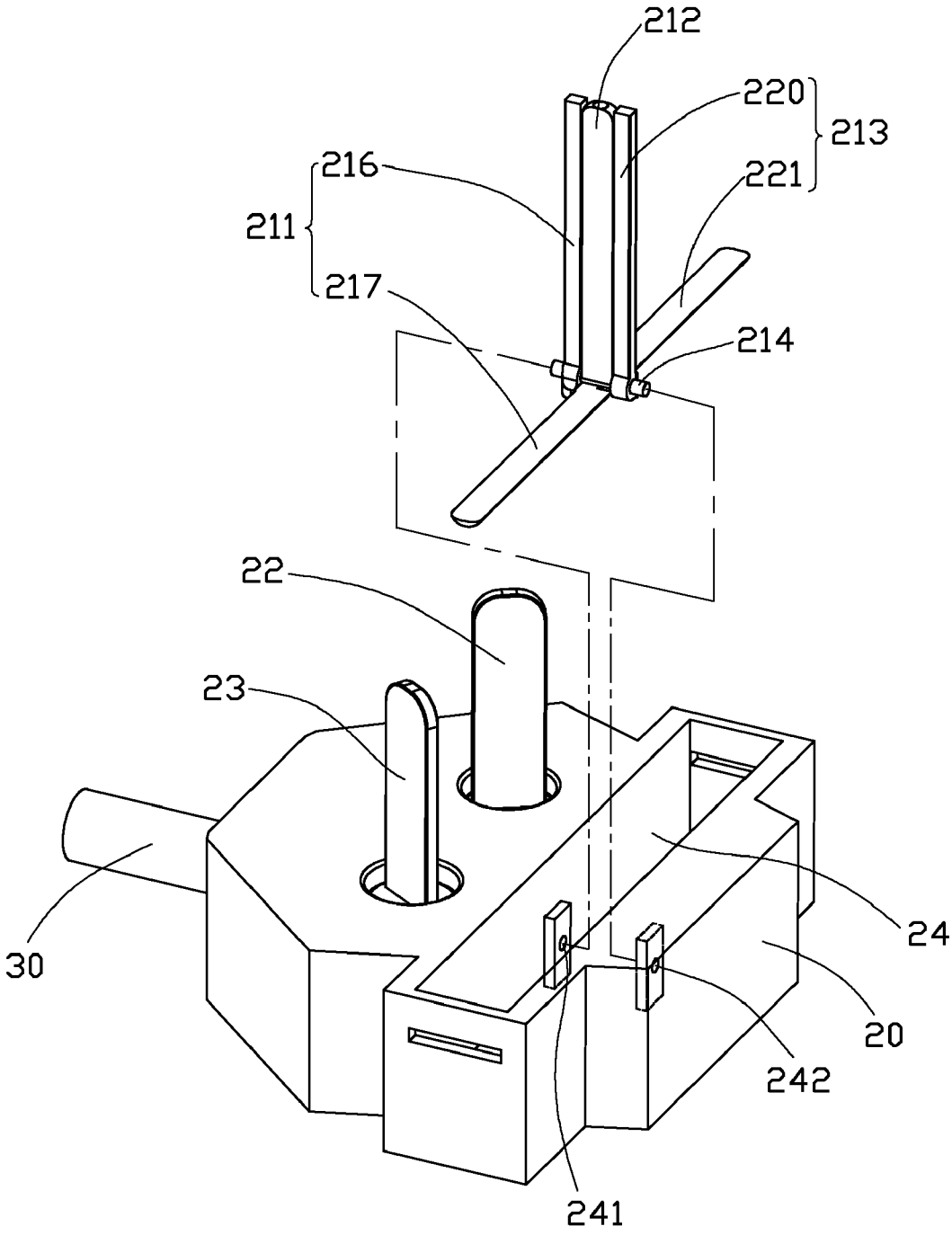
FIG. 6 is a partially exploded view of the plug of FIG. 1.
Figure 7:
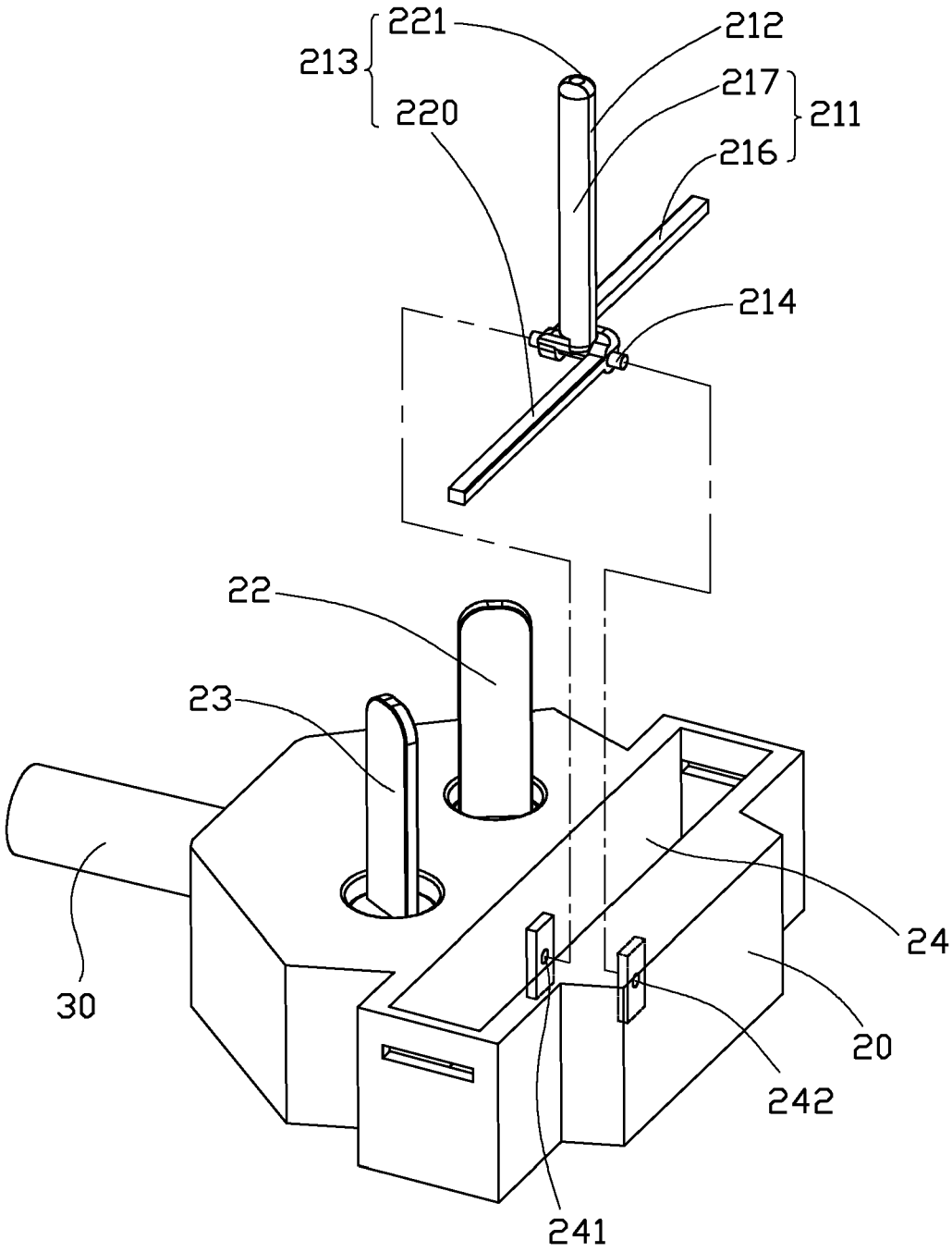
FIG. 7 is a partially exploded view of the plug of FIG. 2.

Referring to FIGS. 6-7, the state of the ground prong 21 can be changed to adapt to a receptacle, when needed. In the embodiment, the ground prong 21 has a first state (FIG. 1) and a second state (FIG. 2). When in the first state, the first pin 216 and the second pin 220 are on the opposite sides of the middle contact 212. When in the second state, the first blade 217 and the second blade 221 are external to the cover 10 and are on the front and rear of the middle contact 212. To switch between the first state and the second state, the cover 10 is first removed. To remove the cover 10, the first hook 14 and the second hook 15 of the cover 10 are pushed until the first hook 14 and the second hook 15 disengage from the first slot 27 and the second slot 28 of the first receiving space 24. After the cover 10 is removed, the first blade 217 and the second blade

221 can be rotated to the front and rear of the middle contact 212. The cover 10 then can be reattached to the base 20.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electrical plug, comprising:

a base;

a cover detachably connected to the base and defining a first hole, a second hole, and a third hole; and a ground prong, a live prong, and a neutral prong, and respectively extending through the first hole, the second hole, and the third hole, the ground prong comprising:

a middle contact fixed to the base;

a first contact comprising a first pin and a first blade fixed to the first pin, the first pin being rotatably connected to the middle contact; and a second contact comprising a second pin and a second blade fixed to the second pin, the second pin being rotatably connected to the middle contact;

wherein the first pin and the second pin are rotatable to a position where the first pin and the second pin are at opposite sides of the middle contact, and the first blade and the second blade are rotatable to a position where the first blade and the second blade are on front and rear of the middle contact.

2. The electrical plug as described in claim 1, wherein the first contact and the second contact further comprise a first positioning member and a second positioning member, respectively, the first positioning member is fixed to one end of the first pin, the first blade is fixed to a side surface of the first positioning member, the second positioning member is fixed to one end of the second pin, the second blade is fixed to a side surface of the second positioning member.

3. The electrical plug as described in claim 2, wherein the ground prong further comprises an axle, the first positioning member and the second positioning member define a first through hole and a second through hole, respectively, one end of the axle extends through the first through hole and the other end of the axle extends through the second through hole to make the first contact and the second contact rotate around the axle.

4. The electrical plug as described in claim 3, wherein the base defines a first receiving space, the first receiving space defines a first opening and a second opening, one end of the axle is received in the first opening, and the other end of the axle is received in the second opening to make the ground prong be receivable in the first receiving space.

5. The electrical plug as described in claim 1, wherein the base further defines a second receiving space and a third receiving space, both of the live prong and the neutral prong comprise a bottom end, each bottom end is received in the corresponding receiving space, respectively.

6. The electrical plug as described in claim 5, wherein each bottom end defines an opening, a tab protrudes from a top rim of the opening, forming a first slot and a second slot, each of the second receiving space and the third receiving space comprises a lateral surface defining a protrusion, each protrusion can be selectively received in the first slot and the second slot to limit the movement of the live prong and the neutral prong.

7. The electrical plug as described in claim 4, wherein the cover comprises two hooks at its opposite sides, the first receiving space comprises two sidewalls defining two slots, each hook engages with each slot to attach the cover to the base.

8. The electrical plug as described in claim 1, further comprising a cable guiding member, wherein a cable extends out through the cable guiding member.

* * * * *